US008104835B2

(12) United States Patent
Ovre et al.

(10) Patent No.: US 8,104,835 B2
(45) Date of Patent: Jan. 31, 2012

(54) STANDING FRAME WITH SUPINE MODE

(75) Inventors: Wesley L. Ovre, Redwood Falls, MN (US); Mathew A. Haugen, Hector, MN (US); Jeffrey V. Schmidt, Redwood Falls, MN (US); Leo J. Schweiss, Fairfax, MN (US); Michael W. Lokken, Grove City, MN (US)

(73) Assignee: Invacare Corp., Elyria, OH (US)

( * ) Notice: Subject to any disclaimer, the term of this patent is extended or adjusted under 35 U.S.C. 154(b) by 313 days.

(21) Appl. No.: 12/169,492

(22) Filed: Jul. 8, 2008

(65) Prior Publication Data

US 2010/0007180 A1 Jan. 14, 2010

(51) Int. Cl.
*A61G 15/00* (2006.01)

(52) U.S. Cl. ..... 297/340; 297/325; 297/DIG. 4; 297/DIG. 10

(58) Field of Classification Search ..... 297/330, 297/DIG. 10, 423.12, 91, 69, 340, DIG. 4, 297/68, 118, 90, 88, 325; 5/81.1 R, 83.1, 5/624

See application file for complete search history.

(56) References Cited

U.S. PATENT DOCUMENTS

| | | | | | |
|---|---|---|---|---|---|
| 481,040 | A | * | 8/1892 | Longanecker | 297/76 |
| 1,731,375 | A | | 10/1929 | Engers | |
| 2,375,151 | A | * | 5/1945 | Troxell | 297/83 |
| 1,858,103 | A | | 5/1952 | Menon | |
| 3,023,048 | A | | 2/1962 | Barton | |
| 3,322,460 | A | | 5/1967 | Leverman | |
| 3,379,450 | A | * | 4/1968 | Jones et al. | 280/657 |
| 3,964,786 | A | * | 6/1976 | Mashuda | 297/330 |
| 4,054,319 | A | | 10/1977 | Fogg, Jr. et al. | |
| 4,249,774 | A | | 2/1981 | Andreasson | |
| 4,456,086 | A | | 6/1984 | Wier et al. | |
| 4,545,616 | A | | 10/1985 | Booth | |
| 4,555,121 | A | | 11/1985 | Lockard et al. | |
| 4,569,094 | A | | 2/1986 | Hart et al. | |
| 4,569,556 | A | | 2/1986 | Pillot | |
| 4,632,455 | A | | 12/1986 | Schiller et al. | |
| 4,725,056 | A | | 2/1988 | Rehrl et al. | |
| 4,732,402 | A | | 3/1988 | Lambert | |
| 4,741,547 | A | | 5/1988 | Tholkes | |
| 4,744,578 | A | | 5/1988 | Stearns | |
| 4,802,542 | A | | 2/1989 | Houston et al. | |
| 4,809,804 | A | | 3/1989 | Houston et al. | |

(Continued)

FOREIGN PATENT DOCUMENTS

EP 1859765 11/2007

(Continued)

OTHER PUBLICATIONS

"Symmetry—The First Shear Reducing Solid Seat Standing System," http://www.primeengineering.com, Prime Engineering, 2004.

(Continued)

*Primary Examiner* — Milton Nelson, Jr.
(74) *Attorney, Agent, or Firm* — Calfee, Halter & Griswold LLP

(57) ABSTRACT

An apparatus is disclosed as having, for example, a frame, a backrest assembly including a pivot bracket, a seat assembly pivotably connected to the pivot bracket and the frame, a leg rest assembly pivotably connected to the frame, a link connected to the leg rest assembly at a first pivot joint and the pivot bracket at a second pivot joint, and a lock connected to the leg rest assembly and the frame.

19 Claims, 5 Drawing Sheets

U.S. PATENT DOCUMENTS

| | | | | |
|---|---|---|---|---|
| 4,861,059 | A | 8/1989 | Shirk | |
| 4,890,853 | A | 1/1990 | Olson | |
| 4,915,373 | A | 4/1990 | Walker | |
| 4,968,050 | A | 11/1990 | Kenrick et al. | |
| 5,054,852 | A | 10/1991 | Tholkes | |
| 5,108,202 | A | 4/1992 | Smith | |
| 5,172,925 | A | 12/1992 | Kendrick et al. | |
| 5,230,113 | A | 7/1993 | Foster et al. | |
| 5,242,180 | A | 9/1993 | Bergeron | |
| 5,265,689 | A | 11/1993 | Kauffmann | |
| 5,294,027 | A | 3/1994 | Plastina | |
| 5,316,370 | A | 5/1994 | Newman | |
| 5,340,139 | A | 8/1994 | Davis | |
| 5,484,151 | A | 1/1996 | Tholkes | |
| 5,489,258 | A | 2/1996 | Wohnsen et al. | |
| 5,582,464 | A | 12/1996 | Maymon | |
| 5,586,961 | A | 12/1996 | Quint | |
| 5,611,758 | A | 3/1997 | Rodgers | |
| 5,709,633 | A | 1/1998 | Sokoi | |
| 5,718,442 | A | 2/1998 | Alexander et al. | |
| 5,772,226 | A | 6/1998 | Babichon | |
| 5,803,545 | A | 9/1998 | Guguin | |
| 5,829,766 | A | 11/1998 | Gohlert | |
| 5,860,899 | A | 1/1999 | Rassman | |
| 5,884,935 | A | 3/1999 | Tholkes | |
| 5,924,962 | A | 7/1999 | Rodgers, Jr. | |
| 5,961,179 | A | 10/1999 | Dixon et al. | |
| 5,984,338 | A | 11/1999 | Meyer | |
| 5,984,411 | A | 11/1999 | Galumbeck | |
| 6,125,957 | A | 10/2000 | Kauffmann | |
| D434,198 | S | 11/2000 | Greaves | |
| 6,152,478 | A * | 11/2000 | Hung | 280/650 |
| 6,224,154 | B1 | 5/2001 | Stoki | |
| 6,231,067 | B1 | 5/2001 | Johnson et al. | |
| 6,270,101 | B1 | 8/2001 | Hase | |
| 6,277,056 | B1 | 8/2001 | McBride et al. | |
| 6,368,252 | B1 | 4/2002 | Stearns | |
| 6,368,260 | B1 | 4/2002 | Crews | |
| 6,382,725 | B1 | 5/2002 | Carroll | |
| 6,425,634 | B1 | 7/2002 | Romero | |
| 6,439,657 | B1 | 8/2002 | Tholkes | |
| 6,440,046 | B1 | 8/2002 | Tholkes | |
| 6,527,340 | B1 | 3/2003 | Finch et al. | |
| 6,533,304 | B2 | 3/2003 | Lizama-Troncoso et al. | |
| 6,601,869 | B2 | 8/2003 | Porcheron | |
| 6,619,681 | B2 | 9/2003 | Gutierrez | |
| 6,953,222 | B2 | 10/2005 | Larrick et al. | |
| 7,036,512 | B2 | 5/2006 | Harnois | |
| 7,077,792 | B2 | 7/2006 | Nerenberg | |
| 7,540,565 | B2 | 6/2009 | Lipford | |
| 7,614,639 | B2 | 11/2009 | Tholkes et al. | |
| 2002/0149168 | A1 | 10/2002 | Brown | |
| 2002/0167205 | A1 | 11/2002 | Tholkes et al. | |
| 2006/0097557 | A1 * | 5/2006 | Tholkes et al. | 297/330 |
| 2009/0186747 | A1 | 7/2009 | Lokken et al. | |
| 2010/0013276 | A1 | 1/2010 | Tholkes et al. | |

FOREIGN PATENT DOCUMENTS

| | | |
|---|---|---|
| JP | 2005237516 | 9/2005 |
| WO | 92/14432 | 9/1992 |
| WO | 00/28930 | 5/2000 |

OTHER PUBLICATIONS

"Standing TranStander, 71," http://www.rifton.com/r/Standing/SupineStanders, Rifton Equipment, Community Products, LLC, 2004.
European search report for application No. EP 05 29 2130 dated Dec. 19, 2005.
Permobil Ltd. product brochure, Professional Rehab Series, The Art of Mobility, C500 Vertical, The Art of Mobility, 2 pages, date unknown.
"Gazelle by R82", http://www.snugseat.com/gazelle.com, Snug Seat, Inc., printed Feb. 7, 2006.
Office action from U.S. Appl. No. 12/354,992 dated Feb. 7, 2011.
Response from U.S. Appl. No. 12/354,992 dated Nov. 22, 2010.
International Search Report and Written Opinion from PCT/US99/27298 dated May 23, 2000.
Office action from U.S. Appl. No. 11/247,961 dated Sep. 30, 2008.
Response from U.S. Appl. No. 11/247,961 dated Mar. 26, 2009.
Office action from U.S. Appl. No. 11/247,961 dated Apr. 23, 2009.
Response from U.S. Appl. No. 11/247,961 dated Jun. 15, 2009.
Notice of Allowance from U.S. Appl. No. 11/247,961 dated Jul. 21, 2009.
Office action from U.S. Appl. No. 12/354,992 dated Jul. 21, 2010.
Communication from EP Application Serial No. 05292130.1 dated Jan. 16, 2006.
Communication from EP Application No. 05292130.1 dated Nov. 23, 2006.
Response from EP Application No. 05292130.1 dated Jun. 4, 2007.
Communication from EP Application No. 05292130.1 dated Apr. 24, 2008.
Communication from EP Application No. 05292130.1 dated Aug. 26, 2008.
Response from EP Application No. 05292130.1 dated Oct. 15, 2008.
Communication from EP Application No. 05292130.1 dated Dec. 17, 2009.
Response from EP Application No. 05292130.1 dated Jun. 17, 2010.
AltimateMedical, EasyStand Evolv, Owner's Manual, 2007, 22 pgs.
EasyStand Evolv, p. 8-13 from easystand.com, copyright 2007, Altimate Medical.
Prime Engineering, Grandstand II-Hydraulic Assisted Standing System, 2 pgs., date unknown.
Prime Engineering, The Art of Standing, 2 page web printout dated Oct. 12, 2007 from http://www.primeengineering.com/index.php?n=38&id=43.
Standing Aid of Iowa, Standing Frames, 3 page web printout dated Oct. 12, 2007 from http://www.stand-aid.com/standing_frames_power_standing_frames.htm.
International Preliminary Examination Report from PCT/US99/27298 dated Apr. 3, 2001.
Stand Aid, two page brochure, Stand Aid of Iowa, Inc., date unknown.
Superstand, Pediatric Standing System, Prime Engineering, 2 page brochure, date unknown.
"Lifestand" Lifts Body and Soul 2 page brochure, Lifestand, date unknown.
Levo USA product brochure, Levo Stand-up Wheelchair, 3 pages, date unknown (at least as early as 1999).
Independence Providers, Inc., Lifestand, Standing Wheelchair brochure, 8 pgs., date unknown.
"The Art of Standing", Axiom, Prime Engineering, 2 pg. brochure, date unknown.
Altimate Medical, EasyStand, 7000 Series Magician brochure, copyright 1998, 4 pgs.
Altimate Medical, EasyStand Family of Standing Products, 3 pgs., copyright 1998.
EasyStand 5000 Owner's Manual brochure, 11 pgs., copyright May 1996.
EasyStand, 5000 Series brochure, 8 pgs., copyright 1998, Altimate Medical.
Easy-Stand by Alt Inc. two page brochure, date unknown.
Standing Update, Altimate Medical, 4 page brochure, Spring 1998, vol. 2, No. 1.
Why sit when you can Stand-N-Go?, two page brochure, date unknown.
Your Alternative for Mobility, The Rifton Mobile Stander, two page brochure, date unknown.
Office action from Canadian Application No. 2,523,067 dated Apr. 11, 2011.
Response from Canadian Application No. 2,523,067 dated Jan. 20, 2011.
Office action from Canadian Application No. 2,523,067 dated Jul. 21, 2010.

* cited by examiner

STANDING FRAME WITH SUPINE MODE

BACKGROUND

Sitting and standing aides provide people with disabilities or handicaps with many health and social benefits. Nevertheless, sitting or standing in one position for extended periods of time can increase fatigue.

SUMMARY

According to one embodiment, an apparatus is disclosed as having, for example, a frame, a backrest assembly including a pivot bracket, a seat assembly pivotably connected to the pivot bracket and the frame, a leg rest assembly pivotably connected to the frame, a link connected to the leg rest assembly at a first pivot joint and the pivot bracket at a second pivot joint, and a lock connected to the leg rest assembly and the frame. When two or more objects are described herein as being connected, joined, affixed, or linked, they can be so connected, joined, affixed or linked directly to each other or through one or more intermediary parts or components.

DESCRIPTION OF EMBODIMENTS

Figure 1:
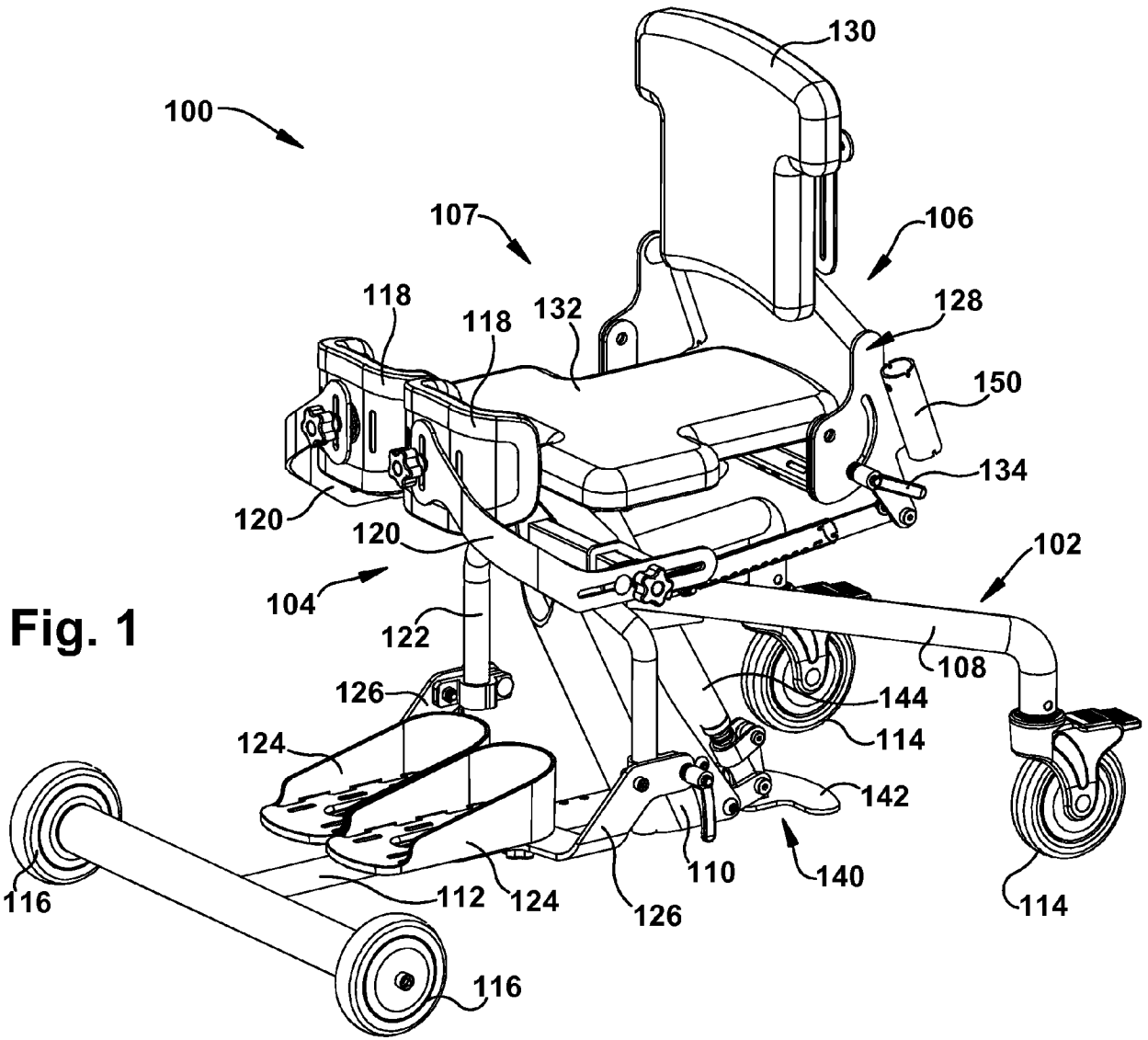
FIG. 1 is a perspective view of one embodiment of an apparatus having multiple posture modes.

FIG. 1 illustrates a perspective view of one embodiment of an apparatus 100 having multiple posture modes. Apparatus 100 includes a frame 102, leg rest assembly 104, backrest assembly 106, and seating assembly 107. Frame 102 includes supports 108 for rear wheels 114, riser support 110, and support 112 for front wheels 116.

Leg rest assembly 104 includes, for example, knee supports 118 and associated brackets 120. Knee support brackets 120 include slots or apertures for variable positioning of the knee supports. Leg rest assembly 104 further includes footrest carriers 122 and associated brackets 126 and footrests 124. Footrest brackets 126 are variably positional on carriers 122 through clamps to accommodate varying user lengths and dimensions. Similarly, footrests 124 are variably positional on brackets 126 to also accommodate varying user dimensions.

Backrest assembly 106 includes, for example, a backrest cushion 130 and is connected to a hip pivot bracket 128. A hip lever clamp 134 releasably connects to pivot bracket 128. Hip pivot bracket also optionally includes an accessory mount 150 for mounting accessories such as a table. Seating assembly 107 includes, for example, a seat cushion 132.

Apparatus 100 also includes, for example, actuator system 140 having foot pedal controller 142 and an actuator 144. Actuator 144 can be mechanical (e.g., spring), pneumatic (i.e., gas), hydraulic (i.e., oil), electric or combinations thereof. A force applied to foot pedal controller 142 activates actuator 144 to assist in raising the seating assembly from the seating mode (FIG. 4) to the standing mode (FIG. 5) and in tilting the system from the seating mode (FIG. 4) to the partially (FIG. 6) or fully supine mode (FIG. 7).

Figure 2:
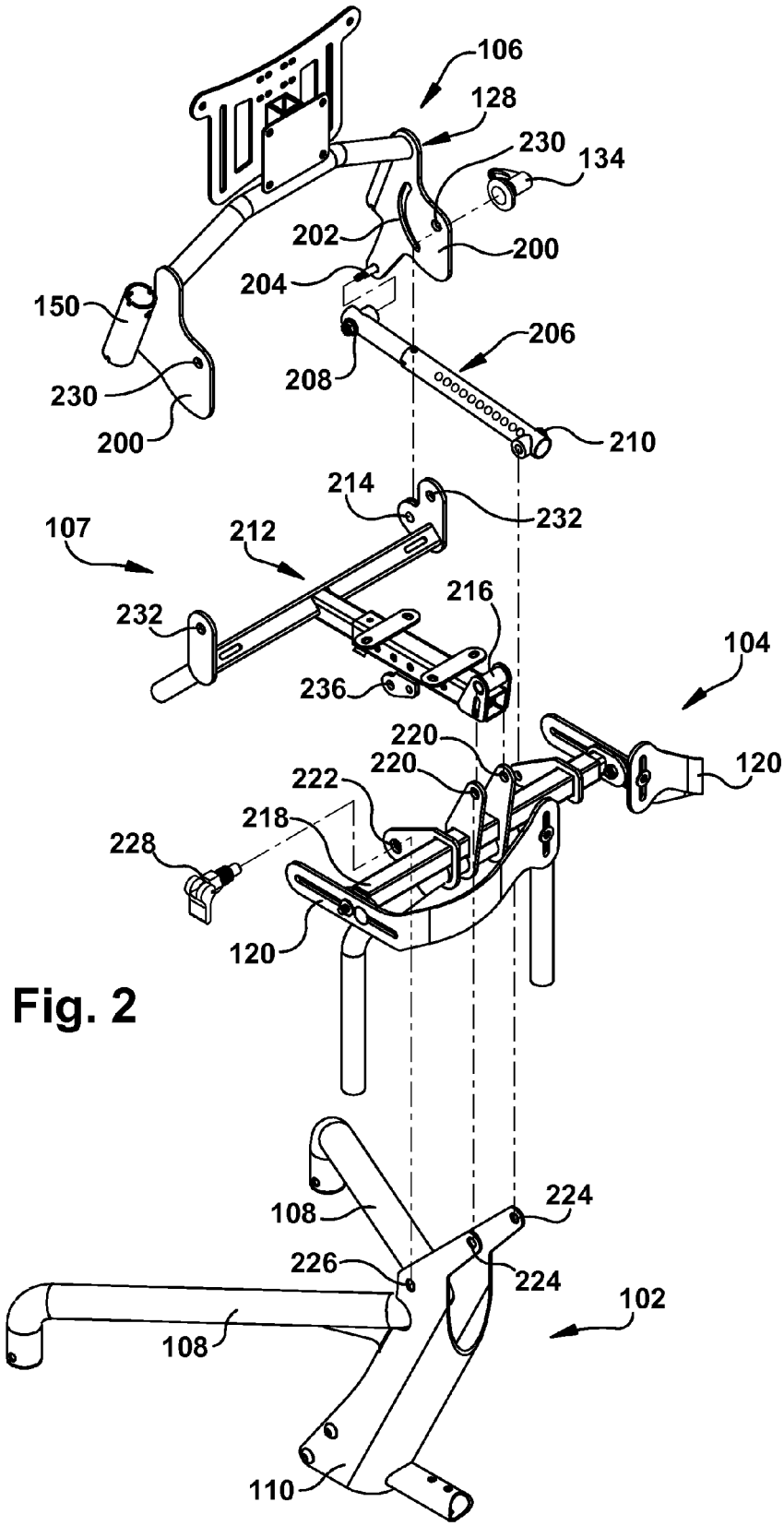
FIG. 2 is a partial exploded view of the apparatus of FIG. 1.
Figure 3:
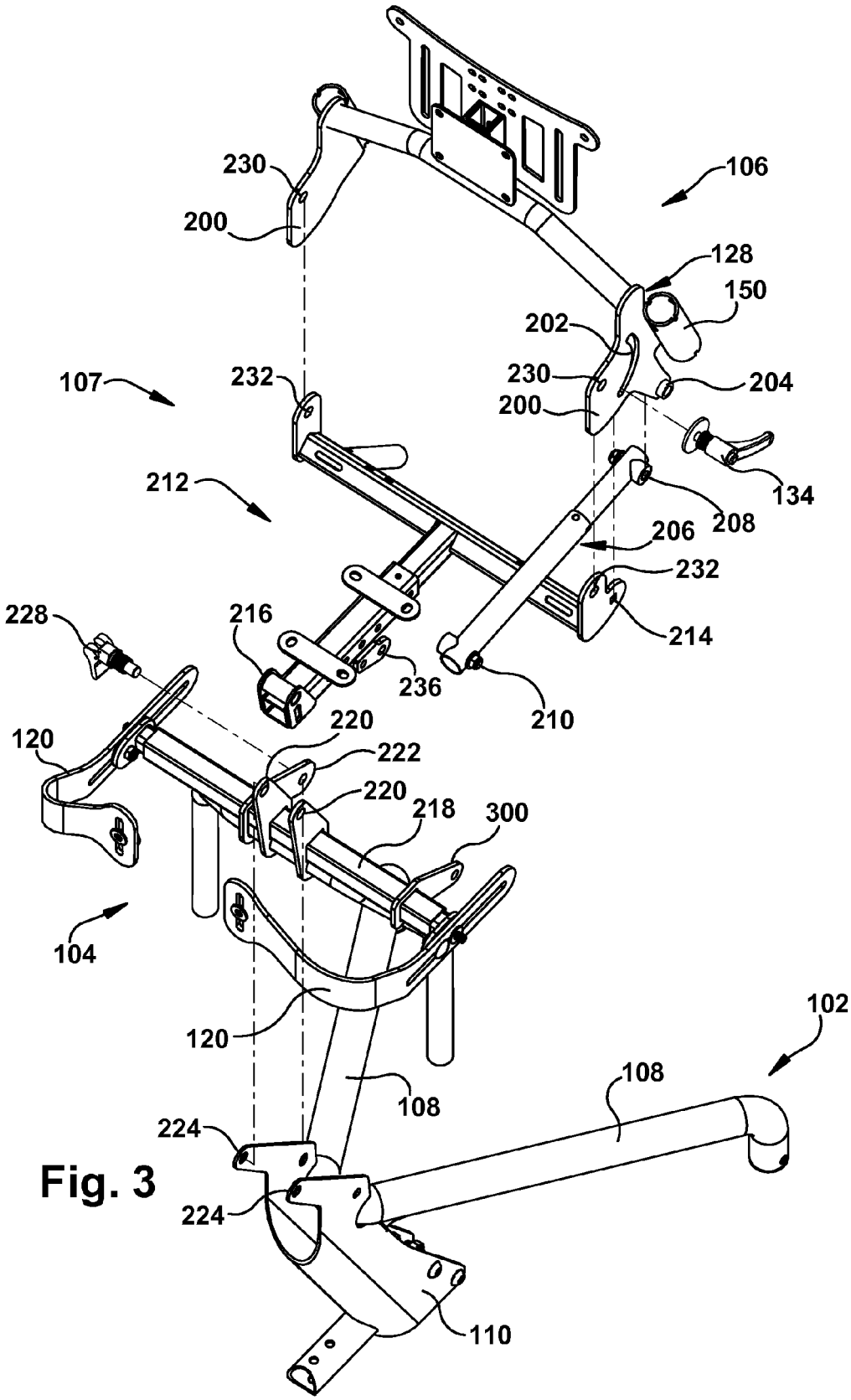
FIG. 3 is another partial exploded view of the apparatus of FIG. 1.

Referring now to FIGS. 2 and 3, partial exploded view of apparatus 100 are shown. Components such as, for example, the backrest and seat cushion, wheels and portions of the frame 102 have been removed for clarity. Hip pivot bracket 128 includes a base 200 and a slot 202. In the embodiment shown, slot 202 is arcuate but can include other shapes. Also, in alternate embodiments, slot 202 may be included in both sides of apparatus 100. An aperture 230 is also provided for pivotably mounting the rear portion of seat cushion 132 and the seating assembly 107 to the hip pivot bracket 128. Hip pivot bracket 128 also includes a projecting portion having pivot joint 204.

A link 206 is pivotably connected to hip pivot bracket 128 and leg rest assembly 104. Link 206 includes an aperture 208 for connecting to pivot joint 204 on hip pivot bracket 128 and an aperture 210 for connecting to leg rest assembly 104. Link 206 further includes a plurality of apertures and locking detent (not shown) for adjustably changing the length of link 206. Link 206 is preferably sized in length to maintain backrest assembly 106 and leg rest assembly 104 in parallel relation to each other as they pivot together.

Seating assembly 107 includes, for example, frame 212 having aperture 214 for accepting a portion of hip lever clamp 134. Hip lever clamp 134 is preferably a friction-type clamp that is operated through a hand lever. Clamp 134 extends through hip bracket slot 202 and aperture 214. Seating assembly frame 212 also includes apertures 232, which line up with apertures 230 in hip pivot bracket 128 to form a pivot joint between the backrest assembly 106 and the seating assembly 107 when connected together (such as through a screw or bolt). In alternate embodiments, apertures 214 may be provided on both sides of seating assembly 107.

Seating assembly frame 212 also includes pivot connection 216 and actuator connection 236. Pivot connection 216 includes, for example, a clevis arrangement having a connecting sleeve. Seating assembly frame 212 further includes a telescoping connection that is held in place through apertures and releasable detent mechanism. In this manner, the length of seating assembly frame 212 can be adjusted based on a user's dimensions. This adjustment effectively positions the hip pivot bracket 128 at hip location of a user or patient. Actuator connection 236 forms a pivotable joint with actuator 144 (FIG. 1) allowing the seating assembly to pivot as actuator 144 adjusts its position.

Leg rest assembly 104 has several pivotable connections. For example, leg rest assembly 104 includes member 218 having pivot brackets 220 thereon. Pivot brackets 220 include apertures therein for connecting the leg rest assembly 104 to the seating assembly's pivot connection 216 and the frame's riser support 110. The seating assembly's pivot connection 216 fits between the leg rest assembly's brackets 220. In this manner, seating assembly 107 can pivot with respect to the leg rest assembly 104.

Riser support 110 also includes brackets 224 having apertures therein. Riser brackets 224 are spaced apart so as to be able to retain the leg rest assembly's brackets 220 and the seating assembly's pivot connection 216 therebetween. A bolt or screw-type fastener is then inserted in the co-located apertures to form a pivot joint about which the seating assembly 107 and leg rest assembly 104 can pivot with respect to the frame 102. In other embodiments, the leg rest assembly 104 and seating assembly 107 can be pivoted on separate joints on the riser support 110 instead of a single common joint.

Leg rest assembly 104 further includes a lock bracket 222 with an aperture therein. Lock bracket 222 cooperates with lock portion 226 on riser support member 110 and locking mechanism 228. Lock portion 226 includes an aperture through which a locking mechanism 228 can be utilized. Locking bracket 222 is structured to co-locate with locking portion 226 so that locking mechanism 228 can be extended and retracted through the co-located apertures. Locking mechanism 228 can be in the form of a cam-operated plunger lock, clamp, detent or other locking mechanism. When locking mechanism 228 is extended through locking bracket 222 and locking portion 226, leg rest assembly 104 remains fixed with respect to frame 102. When locking mechanism 228 is retracted, the leg rest assembly 104 can pivot with respect to frame 102.

Referring now particularly to FIG. 3, leg rest assembly 104 also has a link bracket 300 with an aperture therein. Link bracket 300 pivotably connects to link 206 through aperture 210. This pivotable connection or joint links leg rest assembly 104 to back rest assembly 106 via link 206. So arranged, when leg rest assembly 104 is not locked, pivotal movement of either the leg rest assembly 104 or the back rest assembly 106 will cause pivotal movement of the other assembly by virtue of link 206.

Figure 4:
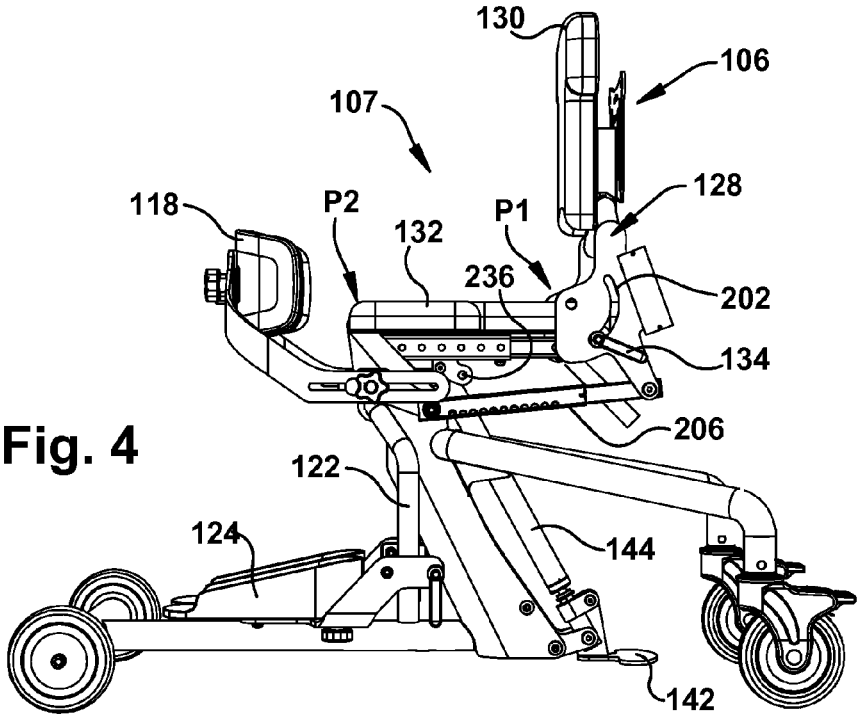
FIG. 4 is a side elevation view of one embodiment of the apparatus in a seating mode.

The length of link 206 is, in one embodiment, sized so that backrest assembly 106 stays in parallel relation to footrest carriers 122. This parallel constraint assists in providing upper torso support as seating assembly 107 is pivoted to the standing mode (FIG. 5) from the sitting mode (FIG. 4). The parallel relation is maintained by a four-bar linkage assembly having link 206 as the first link, hip pivot bracket 128 as the second link, link pivot bracket 300 as the third link, and seat frame 212 as the fourth link. By sizing the length of link 206 and the length of seat frame 212 to similar or identical dimensions, a substantially parallel or parallel relation is maintained between back rest assembly 106 and footrest carriers 122. Through this configuration, backrest assembly 106 reclines while footrest carriers 122 simultaneously elevates, or vice versa. In other embodiments, link 206 can be sized to maintain a non-parallel relation between backrest assembly 106 and footrest carriers 122, if necessary.

Figure 5:
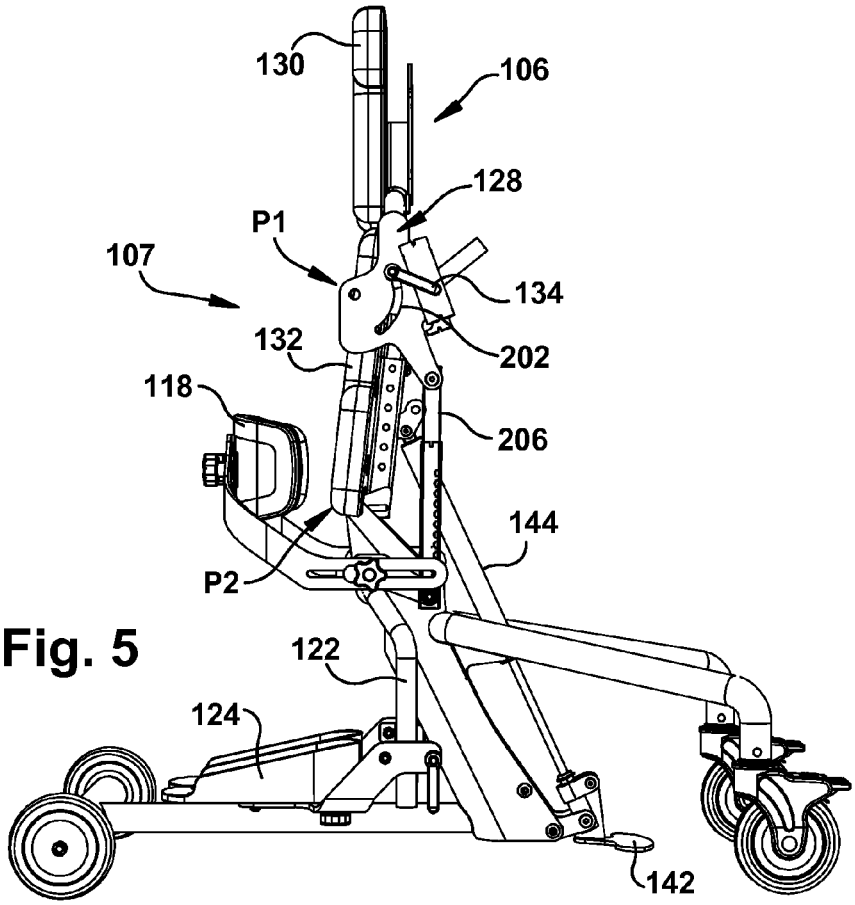
FIG. 5 is a side elevation view of one embodiment of the apparatus in a standing mode.

Referring now to FIG. 4, the apparatus is shown in the seating mode with backrest assembly 106 substantially parallel to footrest carriers 122. FIG. 5 illustrates the apparatus in the standing mode with backrest assembly 106 also substantially parallel to footrest carriers 122. In one embodiment, changing from the seating to the standing mode is accomplished by loosening hip lever clamp 134 and pressing actuator foot pedal 142. Loosening hip lever clamp 134 frees hip pivot bracket 128 to pivot about joint P1. Pressing actuator foot pedal 142 allows actuator 144 to assist in raising seating assembly 107 from the seated position (FIG. 4) to the standing position (FIG. 5). Seating assembly 107 pivots about joint P2 thereby raising its rear portion. Once in the standing position (FIG. 5), hip lever clamp 134 is tightened to lock the backrest assembly 106, seating assembly 107 and leg rest assembly 104 into place with respect to each other. As shown in FIG. 5, the backrest assembly 106, seating assembly 107, and leg rest assembly 104 substantially reside in a plane or form a planer configuration in the standing mode. It should be noted that backrest assembly 106, seating assembly 107 and leg rest assembly 104 need not be placed in a planar configuration, but may be placed in angled relation to each other to form a partially standing or partially seated mode or configuration.

Figure 6:
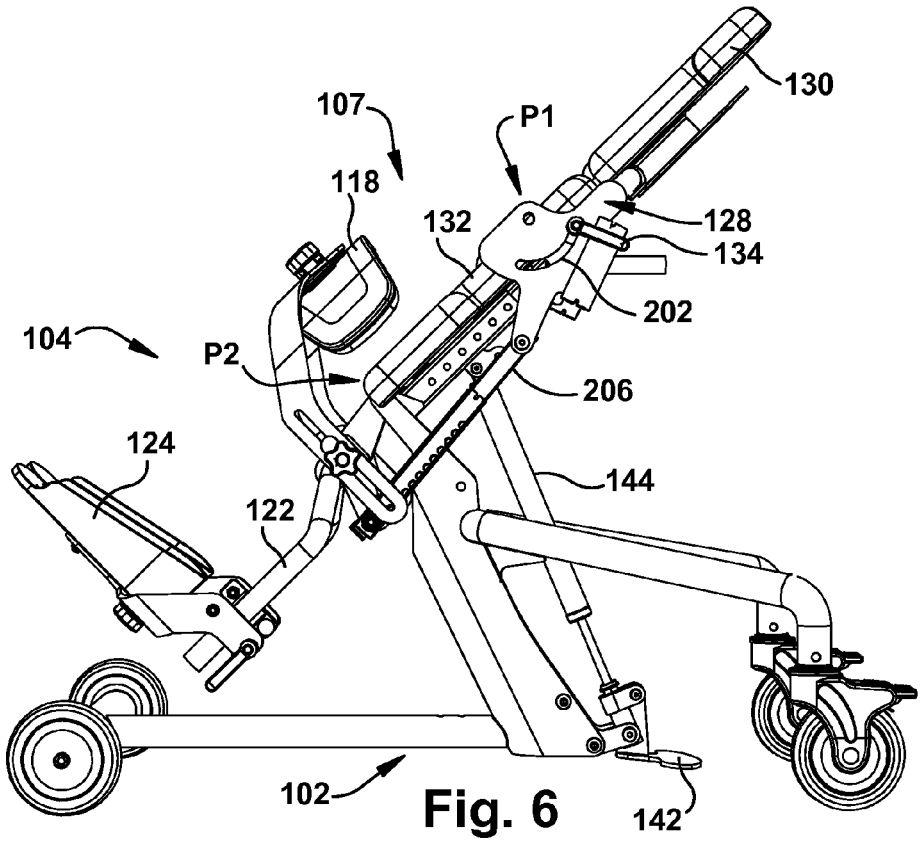
FIG. 6 is a side elevation view of one embodiment of the apparatus in a partial supine mode.
Figure 7:
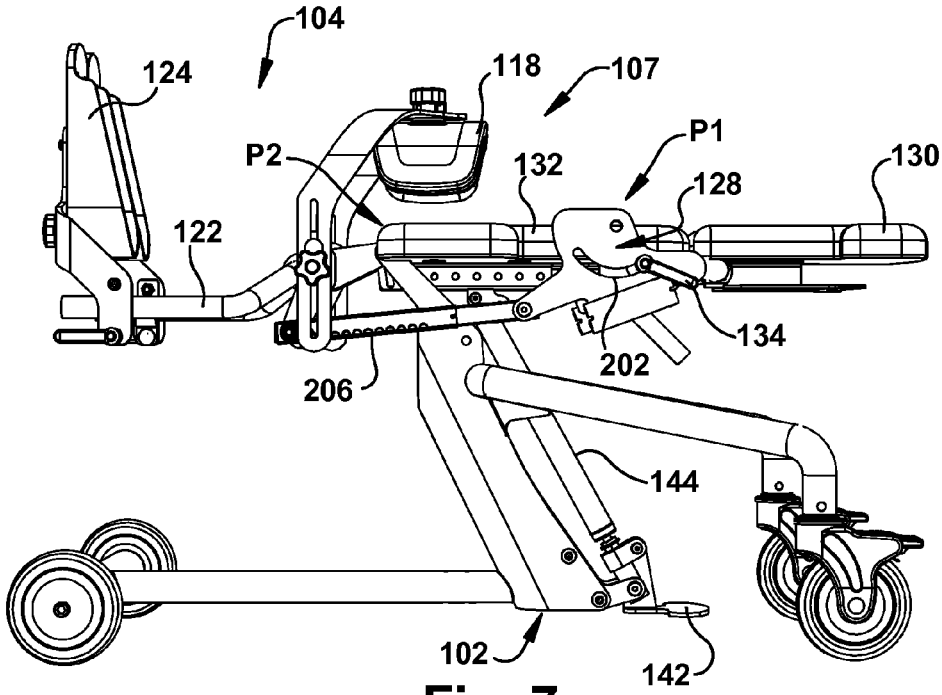
FIG. 7 is a side elevation view of one embodiment of the apparatus in a full supine mode.

FIG. 6 illustrates the apparatus in a partial supine position or mode. From the standing mode (FIG. 5), the partial or full supine mode (FIGS. 6 and 7) is obtained by releasing or unlocking leg rest assembly 104 from frame 102 via locking mechanism 228 (FIG. 2). Locking mechanism 228 unlocks locking bracket 222 from frame 102 thereby freeing leg rest assembly 104 to rotate or pivot about frame 102. In the case where locking mechanism 228 is a cammed plunger lock with a cammed paddle and plunger, the paddle is rotated to retract the plunger by camming action from the aperture of locking bracket 222.

Since backrest assembly 106, seating assembly 107, and leg rest assembly 104 are locked with respect to each other, pivoting of leg rest assembly 104 about joint P2 after unlocking it from frame 102 effects tilting of the entire configuration about joint P2. The tilting is assisted by pressing actuator pedal 142 to allow actuator 144 to assist in the change in position or modes. From the standing position or mode (FIG. 5), the apparatus can be tilted through a number of angles such as, for example, 0 to more or less than 90 degrees. FIG. 7 is similar to FIG. 6 but illustrates the apparatus in the full supine position or mode being tilted approximately 85 to 90 degrees from the standing position or mode.

Configured as such in this embodiment, the apparatus is appropriately jointed at the hip and knee areas to coincide with the locations of the natural joints of a user or patient. By having adjustable seating systems, connecting links and brackets, a high degree of adjustability of the apparatus can be obtained to effect accurate positioning of supports related to a user's feet, knees, hips, and back. Accurate positioning and movement reduce the likelihood of hyper-extending the joints of the user or patient.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. For example, where a joint forms a common pivot for more then one component, separate joints can be implemented. Also, more or less component adjustability may be provided than in the illustrated examples. Furthermore, components such as assistive actuators may be eliminated entirely or supplemented by additional actuators (including powered and manual actuators). Still further, component geometries, shapes, and dimensions can be modified without changing the overall role or function of the components. Additionally, locking mechanisms can be in the form of clamps, locks, plungers, detents, and other similar type devices and pivots can be in the form of joints, hinges, swivels, wheels or similar type devices. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

What is claimed:

1. An apparatus comprising:

a frame;

a backrest assembly comprising a pivot bracket;

a seat assembly pivotably connected to the pivot bracket and the frame;

a leg rest assembly pivotably connected to the frame;

a link connected to the leg rest assembly at a first pivot joint and the pivot bracket at a second pivot joint; and a lock connected to the leg rest assembly and the frame, wherein in a first position the lock prohibits movement of the leg rest assembly relative to the frame and in a second position the lock permits pivotal movement of the leg rest assembly relative to the frame;

wherein the seat assembly is permitted to move independent of the leg rest assembly when the lock is in the first position; and wherein the apparatus is configured to transition from a seating mode to a standing mode and from the standing mode to a supine mode.

2. The apparatus of claim 1 wherein, in the first position, the lock prohibits the movement of the leg rest assembly relative to the frame such that the apparatus is permitted to transition from the seating mode to the standing mode.

3. The apparatus of claim 1 wherein, in the second position, the lock permits pivotal the movement of leg rest assembly relative to the frame such that the apparatus is permitted to transition from the standing mode to the supine mode.

4. The apparatus of claim 1 wherein the link permits the leg rest assembly and the back rest assembly to pivot together, when the apparatus transitions from the standing mode to the supine mode.

5. The apparatus of claim 1 wherein the leg rest assembly comprises a lock bracket.

6. The apparatus of claim 1 wherein the frame comprises a pivot bracket connected to the seat assembly and the leg rest assembly.

7. The apparatus of claim 1 wherein the seat assembly comprises a plurality of apertures for adjusting the length of the seat assembly.

8. The apparatus of claim 1 wherein the lock includes a cam release assembly.

9. The apparatus of claim 1 further comprising a releasable clamp between the backrest assembly and the seat assembly.

10. The apparatus of claim 1 wherein the pivot bracket comprises an arcuate slot.

11. The apparatus of claim 1 wherein the pivot bracket comprises an arcuate slot and a projection.

12. The apparatus of claim 1 further comprising an actuator connected between the frame and the seating assembly.

13. An apparatus comprising:

a frame means;

a means for supporting a user's back;

a means for supporting a user's seat;

a means for supporting a user's legs;

a means for linking the means for supporting a user's back and legs so that they move together and are maintained in a parallel relation to each other;

a lock connected to the means for supporting a user's legs and the frame means, wherein in a first position the lock prohibits movement of the means for supporting a user's legs relative to the frame means and in a second position the lock permits pivotal movement of the means for supporting a user's legs relative to the frame means;

wherein the means for supporting a user's seat is permitted to move independent of the means for supporting a user's legs when the lock is in the first position;

a means for locking the means for supporting a user's back to the means for supporting a user's legs; and a means for pivotably connecting the means for supporting a user's seat and legs to the frame means.

14. The apparatus of claim 13 further comprising a means for pivotably connecting the means for supporting a user's back to the means for supporting a user's seat.

15. The apparatus of claim 13 further comprising a means for adjusting the length of the means for supporting a user's seat.

16. An apparatus comprising:

a frame having a first pivot joint;

a seat assembly connected to the first pivot joint;

a backrest assembly;

a hip bracket connecting the seat assembly to the backrest assembly, the hip bracket comprising an arcuate slot and a projecting member;

a clamp for locking the backrest assembly to the seat assembly through the arcuate slot;

a leg rest assembly pivotably connected to the frame and comprising a locking bracket and a link bracket;

a lock configured to lock and release the leg rest assembly to the frame; and a link connected to the link bracket and the projecting member.

17. The apparatus of claim 16 further comprising wheels and a sitting mode, standing mode and supine mode.

18. The apparatus of claim 16 wherein the clamp comprises a lever.

19. The apparatus of claim 16 wherein the lock comprises a cam release.

* * * * *